US007407919B2

(12) United States Patent
Wilk et al.

(10) Patent No.: US 7,407,919 B2
(45) Date of Patent: Aug. 5, 2008

(54) SULFONATE DETERGENT SYSTEM FOR IMPROVED FUEL ECONOMY

(75) Inventors: Melody A. Wilk, Timberlake, OH (US); Brent R. Dohner, Concord, OH (US); Frank V. Zalar, Novelty, OH (US); Jack C. Kelley, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 330 days.

(21) Appl. No.: 10/492,638

(22) PCT Filed: Oct. 15, 2002

(86) PCT No.: PCT/US02/33117

§ 371 (c)(1),
(2), (4) Date: Apr. 14, 2004

(87) PCT Pub. No.: WO03/040273

PCT Pub. Date: May 15, 2003

(65) Prior Publication Data

US 2005/0065045 A1 Mar. 24, 2005

(51) Int. Cl.
*C10M 133/06* (2006.01)
*C10M 169/04* (2006.01)
*C10M 159/20* (2006.01)

(52) U.S. Cl. ..... 508/399; 508/545; 508/483

(58) Field of Classification Search ..... 508/399, 508/483, 545
See application file for complete search history.

(56) References Cited

U.S. PATENT DOCUMENTS

| | | | | | |
|---|---|---|---|---|---|
| 3,644,277 | A * | 2/1972 | Gilles | 524/101 |
| 4,326,972 | A * | 4/1982 | Chamberlin, III | 508/331 |
| 4,767,551 | A * | 8/1988 | Hunt et al. | 508/292 |
| 4,938,881 | A * | 7/1990 | Ripple et al. | 508/237 |
| 4,952,328 | A * | 8/1990 | Davis et al. | 508/237 |
| 5,422,022 | A * | 6/1995 | Chamberlin, III | 508/390 |
| 5,439,605 | A * | 8/1995 | Khorramian | 508/198 |
| 5,490,945 | A * | 2/1996 | Smith et al. | 508/375 |
| 5,516,441 | A * | 5/1996 | Denis | 508/197 |
| 5,652,201 | A | 7/1997 | Papay et al. | |
| 5,674,820 | A * | 10/1997 | Manka et al. | 508/287 |
| 5,792,732 | A * | 8/1998 | Jao et al. | 508/391 |
| 6,187,722 | B1 * | 2/2001 | Rowland et al. | 508/284 |
| 2001/0044387 | A1 * | 11/2001 | Inoue et al. | 508/186 |
| 2002/0006878 | A1 | 1/2002 | Abraham et al. | |

FOREIGN PATENT DOCUMENTS

| | | | |
|---|---|---|---|
| EP | 0 881 277 | | 12/1998 |
| EP | 1 016 706 | | 12/1999 |
| EP | 1 041 135 | | 10/2000 |
| EP | 1 059 301 | | 12/2000 |
| EP | 1059301 | A1 * | 12/2000 |
| EP | 1 227 145 | | 7/2002 |
| WO | WO 0144419 | A * | 6/2001 |
| WO | WO 01/74978 | | 10/2001 |

OTHER PUBLICATIONS

Notice of Opposition dated Jan. 5, 2006.
Letter by Opponent dated Jan. 9, 2006.
"Irganox® L 135", printed Jul. 1997, by Ciba Specialty Chemicals.
"Ethyl Corporation Material Safety Data Sheet, HiTEC 611 Performance Additive", dated Apr. 6, 1998.
"Naugalube Lubricant additives, Naugalube 438® L", dated 1997.
"Naugalube® 438L", dated Feb. 1992.

* cited by examiner

*Primary Examiner*—Glenn Caldarola
*Assistant Examiner*—Jim Goloboy
(74) *Attorney, Agent, or Firm*—David M. Shold; Christopher D. Hilker

(57) ABSTRACT

A composition for lubricating an internal combustion engine includes an oil of lubricating viscosity; a predominantly linear alkylbenzenesulfonate detergent having a metal ratio of at least 8; and a combination of hindered phenolic ester antioxidant and aromatic amine antioxidant. The amount of any phenate detergent is less than 15% by weight of the total amount of detergents.

13 Claims, No Drawings

SULFONATE DETERGENT SYSTEM FOR IMPROVED FUEL ECONOMY

BACKGROUND OF THE INVENTION

The present invention relates to a composition and method for lubricating an internal combustion engine, providing improved fuel economy and retention of fuel economy.

Fuel economy is of great importance, and lubricants which can foster improved fuel economy, by, for instance, leading to reduced friction within an engine, are of significant value. The present invention provides a lubricant composition, including an additive package, which leads to improved fuel economy in an internal combustion engine. This improvement is effected by providing an additive package in which the detergent component is exclusively or predominantly an alkylsulfonate.

U.S. Pat. No. 4,952,328, Davis et al., Aug. 28, 2990, discloses lubricating oil compositions for internal combustion engines, comprising (A) oil of lubricating viscosity, (B) a carboxylic derivative produced by reacting a succinic acylating agent with certain amines, and (C) a basic alkali metal salt of sulfonic or carboxylic acid. An illustrative lubricant composition (Lubricant III) includes base oil including viscosity index modifier; a basic magnesium alkylated benzene sulfonate; an overbased sodium alkylbenzene sulfonate; a basic calcium alkylated benzene sulfonate; succinimide dispersant; and zinc salts of a phosphorodithioic acids.

U.S. Pat. No. 4,326,972, Chamberlin, Apr. 27, 1982, discloses lubricant compositions for improving fuel economy of internal combustion engines. The composition includes a specific sulfurized composition (based on an ester of a carboxylic acid) and a basic alkali metal sulfonate. Additional ingredients may include at least one oil-dispersible detergent or dispersant, a viscosity improving agent, and a specific salt of a phosphorus acid.

U.S. Pat. No. 3,994,815, Coleman, Nov. 30, 1976, discloses lubricating compositions. Disclosed in an example is an additive concentrate prepared using a polyisobutylene synthetic lubricating oil containing a hydrogenated butadiene-styrene copolymer; a dispersant; a zinc isobutylamyl phosphorodithioate, an overbased calcium sulfonate detergent, and an anti-foaming agent.

SUMMARY OF THE INVENTION

The present invention provides a composition suitable for lubricating an internal combustion engine, comprising the following components:

(a) an oil of lubricating viscosity;

(b) an overbased detergent, wherein the detergent is exclusively or predominantly a linear alkylbenzenesulfonate detergent having a metal ratio of at least 8, wherein in said composition the amount of phenate detergent is less than 15% by weight of the total amount of detergents (c) a combination of antioxidants comprising (i) 0.1 to 2 weight percent hindered phenolic ester antioxidant and (ii) 0.2 to 2 weight percent aromatic amine antioxidant; and (d) at least one further component selected from the group consisting of dispersants, zinc dialkyldithiophosphates, and friction modifiers.

The invention also provides a method for lubricating an internal combustion engine, comprising supplying to such engine the lubricant described above.

The invention also provides a concentrate comprising a concentrate-forming amount of an oil of lubricating viscosity and corresponding amounts of components (b), (c), and (d).

DETAILED DESCRIPTION OF THE INVENTION

Various preferred features and embodiments will be described below by way of non-limiting illustration.

Component (a) is an oil of lubricating viscosity, which term includes natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of dicarboxylic acids and polyols, esters of phosphorus-containing acids, polymeric tetrahydrofurans and silicon-based oils.

Specific examples of the oils of lubricating viscosity are described in U.S. Pat. No. 4,326,972 and European Patent Publication 107,282. A basic, brief description of lubricant base oils appears in an article by D. V. Brock, "Lubricant Base Oils", Lubrication Engineering, Volume 43, pages 184-185, March, 1987. A description of oils of lubricating viscosity occurs in U.S. Pat. No. 4,582,618 (column 2, line 37 through column 3, line 63, inclusive).

The oils used in the present invention can preferably be API Group II or Group III oils. These are generally mineral oil based oils which are relatively low in sulfur content and high in saturate content. Group II oils contain $\leqq$0.03% sulfur and $\geqq$90% saturates and a viscosity index of 80 to 120. Group III oils are similar but have a viscosity index of $\geqq$120. Excluded from these categories are polyalphaolefins, which are separately categorized as Group IV.

The lubricating oil in the invention will normally comprise the major amount of the composition. Thus it will normally be at least 50% by weight of the composition, preferably about 83 to about 98%, and most preferably about 88 to about 90%. As an alternative embodiment, however, the present invention can provide an additive concentrate in which the oil can be 0 to about 20% by weight, preferably about 1 to about 10%, and the other components, described in greater detail below, are proportionately increased.

Component (b) is a detergent which is predominantly or exclusively a sulfonate detergent. These are specifically overbased materials, and specifically overbased alkylbenzenesulfonate detergents, more particularly linear alkylbenzenesulfonate detergents.

Overbased materials are single phase, homogeneous Newtonian systems characterized by a metal content in excess of that which would be present according to the stoichiometry of the metal and the particular acidic organic compound reacted with the metal.

The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The metal ratio for a sulfonate detergent is calculated based on the ratio of metal to the sulfonate functionality, ignoring the presence of any other incidental acidic groups that may be present in the detergent molecule. The metal ratio of the sulfonate detergents used in the present invention will typically be at least 8, for example, 8 to 35, preferably 10 to 30 or 15 to 25, or, in one instance, about 20.

The basicity of the overbased materials of the present invention generally is expressed in terms of a total base number. A total base number is the amount of acid (perchloric or hydrochloric) needed to neutralize all of the overbased material's basicity. The amount of acid is expressed as potassium hydroxide equivalents (mg KOH per gram of sample). The overbased materials generally have a total base number up to 600, preferably 500, more preferably 400. In a preferred embodiment, the TBN of the sulfonate is 300 to 500, preferably about 400.

The overbased materials are prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, or xylene) for said acidic organic material, a stoichiometric excess of a metal base, and a promoter.

The acidic organic compounds useful in making the overbased compositions generally can include carboxylic acids, sulfonic acids, phosphorus-containing acids, phenols or mixtures of two or more thereof. For purposes of the present invention, the acidic organic compounds are sulfonic acids.

The sulfonic acids useful in making the overbased salts of the invention include the sulfonic and thiosulfonic acids. Generally they are salts of sulfonic acids. The sulfonic acids include the mono- or polynuclear aromatic or cycloaliphatic compounds. The oil-soluble sulfonates can be represented for the most part by one of the following formulae: $R_2$-T-$(SO_3^-)_a$ and $R_3$—$(SO_3^-)_b$, wherein T is a cyclic nucleus such as, for example, benzene, naphthalene, anthracene, diphenylene oxide, diphenylene sulfide, or petroleum naphthenes; $R_2$ is an aliphatic group such as alkyl, alkenyl, alkoxy, or alkoxyalkyl; $(R_2)$+T contains a total of at least 15 carbon atoms; and $R_3$ is an aliphatic hydrocarbyl group containing at least 15 carbon atoms. Examples of $R_3$ are alkyl, alkenyl, alkoxyalkyl, and carboalkoxyalkyl. Specific examples of $R_3$ are groups derived from petrolatum, saturated and unsaturated paraffin wax, and the above-described polyalkenes. The groups T, $R_2$, and $R_3$ in the above formulas can also contain other inorganic or organic substituents in addition to those enumerated above such as, for example, hydroxy, mercapto, halogen, nitro, amino, nitroso, sulfide, disulfide, etc. In the above formulas, a and b are at least 1. In one embodiment, the sulfonic acids have a substituent ($R_2$ or $R_3$) which is derived from one of the above-described polyalkenes.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, dilauryl betanaphthalene sulfonic acids, the sulfonic acid derived by the treatment of polybutene having a number average molecular weight ($\overline{M}_n$) in the range of 500 to 5000, preferably 800 to 2000, more preferably about 1500, with chlorosulfonic acid, nitronaphthalene sulfonic acid, paraffin wax sulfonic acid, cetyl-cyclopentane sulfonic acid, lauryl-cyclohexane sulfonic acids, polyethylenyl-substituted sulfonic acids derived from polyethylene ($\overline{M}_n$=300-1000, preferably 750). Normally the aliphatic groups will be alkyl and/or alkenyl groups such that the total number of aliphatic carbons is at least 8, preferably at least 12 up to 400 carbon atoms, preferably up to 250. In a preferred embodiment, the substituent will be an alkyl group having a an appropriate length such that the molecular weight of the alkylbenzene group is 320 to 700 or, more narrowly 380 to 420.

Another group of sulfonic acids are mono-, di-, and tri-alkylated benzene and naphthalene (including hydrogenated forms thereof) sulfonic acids. Illustrative of synthetically produced alkylated benzene and naphthalene sulfonic acids are those containing alkyl substituents having 8 to 30 carbon atoms, preferably 12 to 30 carbon atoms, and advantageously about 24 carbon atoms. Such acids include di-isododecylbenzenesulfonic acid, polybutenyl-substituted benzenesulfonic acid, polypropylenyl-substituted benzenesulfonic acids derived from polypropene having an $\overline{M}_n$=300-1000, preferably 500-700, cetylchlorobenzene sulfonic acid, di-cetylnaphthalene sulfonic acid, di-lauryldiphenylether sulfonic acid, diisononylbenzene sulfonic acid, di-isooctadecylbenzene sulfonic acid, or stearylnaphthalene sulfonic acid.

Specific examples of oil-soluble sulfonic acids are mahogany sulfonic acids; bright stock sulfonic acids; sulfonic acids derived from lubricating oil fractions having a Saybolt viscosity from 100 seconds at 38° C. (100° F.) to 200 seconds at 99° C. (210° F.); petrolatum sulfonic acids; mono- and poly-wax-substituted sulfonic and polysulfonic acids of, e.g., benzene, naphthalene, phenol, diphenyl ether, or naphthalene disulfide; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene bottoms sulfonic acids.

Sulfonate detergents can also be characterized generally as based on either natural sulfonates or on synthetic sulfonates. In both instances, alkylaromatic sulfonates typically predominate. Natural sulfonates tend to contain at least a minimal amount of polycyclic species. Natural sulfonic acids are typically prepared by sulfonataion of suitable petroleum fractions. Synthetic sulfonates, on the other hand, tend to be monocyclic species, mono or di-alkylated. Synthetic alkaryl sulfonic acids are typically prepared from alkylated benzenes such as the Friedel-Crafts reaction products of benzene and alkyl-group providing agents such as tetrapropylene.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, New York (1969).

The metal compounds useful in making the basic metal salts are generally any Group 1 or Group 2 metal compounds (CAS version of the Periodic Table of the Elements). The Group 1 metals of the metal compound include Group 1a alkali metals (such as sodium, potassium, lithium) as well as Group 1b metals such as copper. The Group 1 metals are preferably sodium, potassium, lithium and copper, more preferably sodium or potassium, and more preferably sodium. The Group 2 metals of the metal base include the Group 2a alkaline earth metals (such as magnesium, calcium, barium) as well as the Group 2b metals such as zinc or cadmium. Preferably the Group 2 metals are magnesium, calcium, barium, or zinc, preferably magnesium or calcium, more preferably calcium. A preferred metal is calcium, and the metal can be solely calcium. In a preferred embodiment the composition will contain less than 500, or less than 400, or less than 300 parts per million by weight of metals other than calcium or zinc (the zinc normally being derived from the zinc dialkyldithiophosphate which may be present.) Generally the metal compounds are delivered as metal salts. The anionic portion of the salt can be, e.g., hydroxide, oxide, carbonate, borate, or nitrate.

An acidic gas is employed to accomplish the formation of the basic metal salt (A). The acidic gas is preferably carbon dioxide, or sulfur dioxide, and is most preferably carbon dioxide.

Patents specifically describing techniques for making basic salts of the above-described sulfonic acids, as well as carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

The overbased salt may also be a borated complex. Borated complexes of this type can be prepared by heating the basic metal salt with boric acid at about 50-100° C., the number of equivalents of boric acid being roughly equal to the number of equivalents of metal in the salt. U.S. Pat. No. 3,929,650 discloses borated complexes and their preparation The amount of component (b) in the compositions of the present invention is generally greater than 0.28 percent by weight (on an oil-free basis), preferably at least 0.3, 0.35, or 0.4 percent. The upper amount of this component is not particularly critical, although amounts greater than 1% or 2% in the final lubricating composition are not believed to provide much additional advantage in many circumstances. Of course, these amounts will be correspondingly increased in a concentrate.

In addition to the sulfonate detergent, relatively small amounts of one or more additional detergents can be present. While the presence of phenate detergent as such is not particularly favored, such other detergents as salicylate detergents, saligenin detergents, or salixarate detergents can be, but need not be, present. Salicylate detergents are typically overbased metal salts of alkyl-substituted salicylic acid. These materials are commercially available, for instance, from Shell Oil Company under the tradenames Sap 007 or AC-60. Calcium and magnesium overbased salicylate detergents are known Saligenin detergents are typically overbased metal salts of saligenin derivatives, that is, salts of the condensation product of a hydrocarbyl-substituted phenol with an aldehyde such as formaldehyde. They may be represented by the general structure

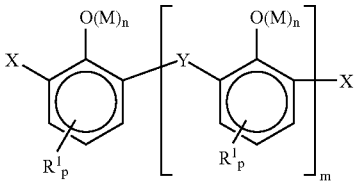

wherein X comprises —CHO or —$CH_2OH$, Y comprises —$CH_2$— or —$CH_2OCH_2$—, and wherein such —CHO groups comprise at least 10 mole percent of the X and Y groups; M is a mono- or di-valent metal ion such as sodium, calcium, or magnesium. Each n is independently 0 or 1. $R^1$ is a hydrocarbyl group containing 1 to 60 carbon atoms, m is 0 to 10, and when m>0, one of the X groups can be H; each p is independently 0, 1, 2 or 3, preferably 1; and that the total number of carbon atoms in all $R^1$ groups is at least 7.

Saligenin detergents and their method of preparation, including their structure, preferred metal ions, extent of neutralization, and preferred amounts and ratios of formaldehyde-derived groups (—$CH_2OCH_2$—, —$CH_2$—, —CHO, and —$CH_2OH$) are described in greater detail in U.S. Pat. No. 6,310,009.

Salixarate detergents are typically the overbased metal salts (typical mateals, as described above, such as sodium, calcium, magnesium) of compounds comprising at least one unit of formula (I) or formula (II):

(I)

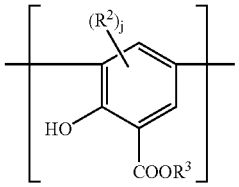

(II)

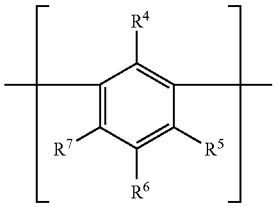

each end of the compound having a terminal group of formula (III) or (IV):

(III)

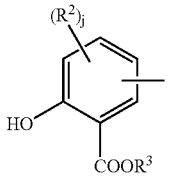

(IV)

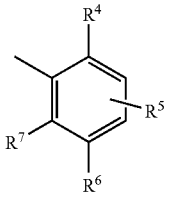

such groups being linked by divalent bridging groups A, which may be the same or different for each linkage. In formulas (I)-(IV) $R^3$ is hydrogen or a hydrocarbyl group; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group. Preferably at least one of $R^4$, $R^5$, $R^6$ and $R^7$ is hydrocarbyl containing at least 8 carbon atoms. The molecules on average contain at least one of unit (I) or (III) and at least one of unit (II) or (IV) and the ratio of the total number of units (I) and (III) to the total number of units of (II) and (IV) in the composition is about 0.1:1 to about 2:1.

The divalent bridging group "A," which may be the same or different in each occurrence, includes —$CH_2$— and —$CH_2OCH_2$—, either of which may be derived from formaldehyde or a formaldehyde equivalent.

Salixarate derivatives and methods of their preparation are described in greater detail in U.S. Pat. No. 6,200,936 and PCT Publication WO 01/56968. The salixarate derivatives may have a predominantly linear, rather than macrocyclic, structure, although both structures are envisioned.

The amount of detergents based on other acidic materials, such as carboxylates, phenates, salicylates, saligenins, or salixarates, should be less than 30% of the total amount of detergent component, or alternatively of the sulfonate detergent, and preferably less than 20%, 15%, 10%, 5%, or 1%. In particular, the amount of any phenate detergents should be less than 15% of the detergents or, alternatively of the sulfonate detergent.

Other additives are preferably included within the lubricating composition. Among these are dispersants, metal salts of phosphorus acids, antioxidants, and friction modifiers such as glycerol monooleate.

Dispersants are well known in the field of lubricants and include primarily what are sometimes referred to as ashless-type dispersants and polymeric dispersants. Ashless type dispersants are so-called because they themselves do not contain ash-forming metals. However, it is known than when mixed with metal-containing components, they may associate with the metals and are no longer technically "ashless." However, they are still to be understood to be "ashless type dispersants" and may be referred to as such. They are characterized by a polar group attached to a relatively high molecular weight hydrocarbon chain. Typical ashless dispersants include N-substituted long chain alkenyl succinimides, having a variety of chemical structures including typically

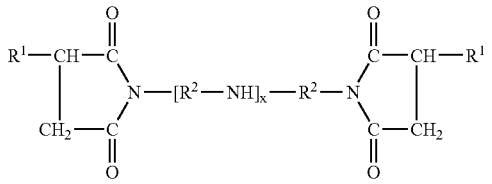

where each $R^1$ is independently an alkyl group, frequently a polyisobutyl group with a molecular weight of 500-5000, and $R^2$ are alkenyl groups, commonly ethylenyl ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435 and 3,172,892, with particular reference to the teaching relating to number of succinic groups per chain and molecular weight limitations of the former patent. In particular, certain desirable dispersants will be based on an acylating agent having substituent groups derived from a polyalkene (such as polyisobutene) characterized by a $\overline{M}_n$ value of 1300 or 1500 to 5000 and a $\overline{M}_w/\overline{M}_n$ value of 1.5 or 1.8 to 4, e.g., 2.0 to 3.4 or 2.5 to 3.2. Such acylating agents will be characterized by the presence within their structure of an average of at least 1.3 (e.g., 1.5 to 2.5) succinic groups for each equivalent weight of substituent groups. The number of equivalent weight of substituent groups is deemed to be the number corresponding to the quotient obtained by dividing the $\overline{M}_n$ value of the polyalkene from which the substituent is derived into the total weight of the substituent groups present in the substituted succinic acylating agent. Thus, if a substituted succinic acylating agent is characterized by a total weight of substituent group of 40,000 and the $\overline{M}_n$ value for the polyalkene from which the substituent groups are derived is 2000, then that total succinic acylating agent is characterized by at total of 20 (40,000/2000=20) equivalent weights of substituent groups. Therefore, that particular succinic acylating agent would also be characterized by the presence within its structure of at least 26 succinic groups.

Another class of dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of dispersant is Mannich bases. These are materials which are formed by the condensation of a higher molecular weight, alkyl substituted phenol, an alkylene polyamine, and an aldehyde such as formaldehyde. Such materials may have the general structure

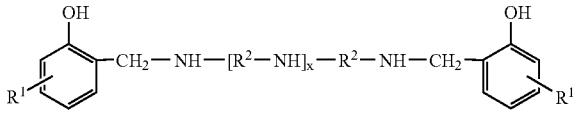

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of the dispersant, if present, is typically 0.5 to 5 percent by weight, preferably 1 to 4 or 2 to 3 percent by weight. Its amount in a concentrate can be correspondingly increased.

The metal salts of phosphorus acids include metal salts of the formula

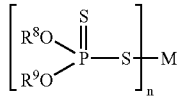

wherein $R^8$ and $R^9$ are independently hydrocarbyl groups containing 3 to 30 carbon atoms are readily obtainable by the reaction of phosphorus pentasulfide ($P_2S_3$) and an alcohol or phenol to form an O,O-dihydrocarbyl phosphorodithioic acid corresponding to the formula

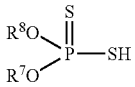

The reaction involves mixing at a temperature of 20° C. to 200° C., four moles of an alcohol or a phenol with one mole of phosphorus pentasulfide. Hydrogen sulfide is liberated in this reaction. The acid is then reacted with a basic metal compound to form the salt. The metal M, having a valence n, generally is aluminum, lead, tin, manganese, cobalt, nickel, zinc, or copper, and most preferably zinc. The basic metal compound is thus preferably zinc oxide, and the resulting metal compound is represented by the formula

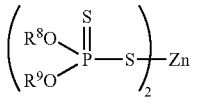

The $R^8$ and $R^9$ groups are independently hydrocarbyl groups that are preferably free from acetylenic and usually also from ethylenic unsaturation. They are typically alkyl, cycloalkyl, aralkyl or alkaryl group and have 3 to 20 carbon atoms, preferably 3 to 16 carbon atoms and most preferably up to 13 carbon atoms, e.g., 3 to 12 carbon atoms. The alcohol which reacts to provide the $R^8$ and $R^9$ groups can be a mixture of a secondary alcohol and a primary alcohol, for instance, preferably a mixture of isopropanol and 4-methyl-2-pentanol. In a preferred embodiment the alcohol mixture comprises 50% or more secondary alcohols, for instance, 50% or more isopropanol. Among specific mixtures of alcohols are 40:60 and 60:40 molar mixtures of 4-methyl-2-pentanol and isopropanol and similar mixtures of 2-ethylhexanol and isopropanol and of iso-octanol and isopropanol.

Such materials are often referred to as zinc dialkyldithiophosphates or simply zinc dithiophosphates. They are well known and readily available to those skilled in the art of lubricant formulation.

The amount of the metal salt of a phosphorus acid in a completely formulated lubricant, if present, can typically be 0.1 to 4 percent by weight, preferably 0.5 to 2 percent by weight, and more preferably 0.75 to 1.25 percent by weight. Its concentration in a concentrate will be correspondingly increased, to, e.g., 5 to 20 weight percent. Alternatively, expressed, the amount of such compound, e.g., a zinc dialkyldithiophosphate, will be an amount to deliver 0.025 to 0.1 weight percent, or 0.35 to 0.8 weight percent, phosphorus to the overall composition.

In a further embodiment, the lubricating oil composition may contain one or more antioxidants. Antioxidants for use in lubricant compositions are well known and include a variety of chemical types including phenate sulfides, phosphosulfurized terpenes, sulfurized esters, aromatic amines, and hindered phenols.

Aromatic amine are typically of the formula

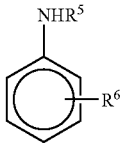

wherein $R^5$ is a phenyl group or a phenyl group substituted by $R^7$, and $R^6$ and $R^7$ are independently a hydrogen or an alkyl group containing 1 to 24 carbon atoms. Preferably $R^5$ is a phenyl group substituted by $R^7$ and $R^6$ and $R^7$ are alkyl groups containing from 4 to 20 carbon atoms. In one embodiment the antioxidant can be an alkylated diphenylamine such as nonylated diphenylamine of the formula

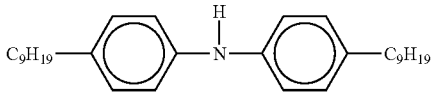

The amount of the aromatic phenol antioxidant is generally 0.2 to 2 weight percent of the composition, preferably 0.3 to 1.5 weight percent or 0.4 to 1 weight percent.

Hindered phenol antioxidants are typically alkyl phenols of the formula

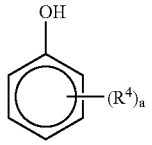

wherein $R^4$ is an alkyl group containing 1 up to 24 carbon atoms and a is an integer of 1 to 5. Preferably $R^4$ contains 4 to 18 carbon atoms and most preferably from 4 to 12 carbon atoms. $R^4$ may be either straight chained or branched chained; branched chained is generally preferred. The preferred value for a is an 1 to 4 and most preferred 1 to 3 or, particularly, 2. Preferably the phenol is a butyl substituted phenol containing 2 or 3 t-butyl groups. When a is 2, the t-butyl groups occupy the 2,6-position, that is, the phenol is sterically hindered:

A particularly preferred antioxidant is a hindered, ester-substituted

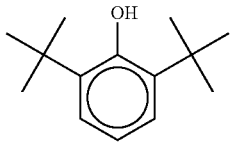

phenol such as one represented by the formula

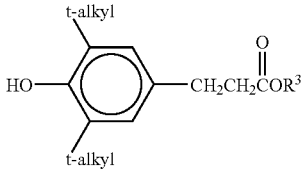

and more preferably

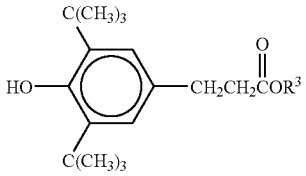

wherein $R^3$ is a straight chain or branched chain alkyl group containing 2 to 22 carbon atoms, preferably 2 to 8, 2 to 6, or 4 to 8 carbon atoms and more preferably 4 or 8 carbon atoms. $R^3$ is desirably a 2-ethylhexyl group or an n-butyl group.

Hindered, ester-substituted phenols can be prepared by heating a 2,6-dialkylphenol with an acrylate ester under base catalysis conditions, such as aqueous KOH.

The amount of the hindered phenolic ester antioxidant is generally 0.1 to 2 weight percent of the composition, preferably 0.2 to 1.5 weight percent or 0.3 to 1 weight percent.

In one embodiment, the antioxidant component of the composition further comprises a sulfurized olefin antioxidant. Such materials are commercially known and are generally formed by treatment of an olefin or a compound containing olefinic unsaturation with sulfur or a sulfurizing agent. The olefinic compounds which may be sulfurized are diverse in nature. They contain at least one olefinic double bond, that is, a non-aromatic double bond connecting two aliphatic carbon atoms. In its broadest sense, the olefin may be defined by the formula $R^1R^2C{=}CR^3R^4$, wherein each of $R^1$, $R^2$, $R^3$ and $R^4$ is hydrogen or an organic group, any two of which may also together form a cyclic alkylene or substituted alkylene group; i.e., the olefinic compound may be alicyclic. In another embodiment, one of the R groups can contain an ester function, e.g., the sulfurized olefin can be sulfurized 4-carbobutoxy cyclohexene.

The olefinic compound is usually one in which each R group which is not hydrogen is independently alkyl, alkenyl or aryl group. Monoolefinic and diolefinic compounds, particularly the former, are preferred, and especially terminal monoolefinic hydrocarbons. Olefinic compounds having about 3 to 30 and especially about 3 to 16 (most often less than 9) carbon atoms are particularly desirable.

Isobutene, propylene and their dimers, trimers and tetramers, and mixtures thereof can be suitable olefinic compounds. In another embodiment, the sulfurized organic compound can be a sulfurized terpene compound.

In one embodiment, sulfurized olefins are produced by (1) reacting sulfur monochloride with a stoichiometric excess of a low carbon atom olefin, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404. The sulfurized olefins also may be prepared by the reaction, under superatmospheric pressure, of olefinic compounds with a mixture of sulfur and hydrogen sulfide in the presence of a catalyst, followed by removal of low boiling materials. This procedure is described in U.S. Pat. No. 4,191,659. The reaction can also be conducted by addition of flowers of sulfur to the olefin at atmospheric pressure, followed by heating. Resulting $H_2S$ can be removed from the mixture by washing with NaOH solution.

The amount of the sulfurized olefin antioxidant is generally 0.1 to 1 weight percent, preferably 0.2 to 0.8 weight percent. The total amount of the various antioxidants can typically be 0.3 to 5 percent by weight of the composition, commonly 0.4 to 4 percent by weight, or to 2 percent or to 1 percent, and typically 0.5 to 0.7 percent.

The compositions of the present invention may also include, or exclude, other components which are commonly found in lubricating compositions. For instance, corrosion inhibitors, extreme pressure agents, and anti-wear agents include but are not limited to chlorinated aliphatic hydrocarbons; boron-containing compounds including borate esters; and molybdenum compounds. Viscosity improvers include but are not limited to polyisobutenes, polymethacrylate acid esters, polyacrylate acid esters, diene polymers, polyalkyl styrenes, alkenyl aryl conjugated diene copolymers, polyolefins and multifunctional viscosity improvers, including dispersant viscosity modifiers (which impart both dispersancy and viscosity improvement). Pour point depressants are a particularly useful type of additive, often included in the lubricating oils described herein usually comprising substances such as polymethacrylates, styrene-based polymers, crosslinked alkyl phenols, or alkyl naphthalenes. See for example, page 8 of "Lubricant Additives" by C. V. Smalheer and R. Kennedy Smith (Lesius-Hiles Company Publishers, Cleveland, Ohio, 1967). Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162. These and other additives which may be used in combination with the present invention are described in greater detail in U.S. Pat. No. 4,582,618 (column 14, line 52 through column 17, line 16, inclusive)

The composition described above is prepared by mixing the components. The order or manner of mixing is not considered to be particularly important.

EXAMPLES

The following formulations are prepared in an oil of lubricating viscosity, where the amounts of the additive components are in percent by weight, excluding diluent oil:

| | Example | | | |
|---|---|---|---|---|
| | 1 | 2 | 3 | 4 |
| Succinimide dispersant | 2.5 | 2.5 | 2.5 | 2.5 |
| Zinc dialkyldithiophosphate | 1.0 | 1.0 | 1.0 | 1.0 |
| Antioxidants | 0.6 | 0.6 | 0.6 | 0.6 |
| Glycerol monooleate | 0.5 | 0.5 | 0.5 | 0.5 |
| 400 TBN calcium sulfonate detergent[a] | 0.4 | 0.8 | 0.7 | 0.4 |
| 300 TBN calcium sulfonate detergent[a] | 0.55 | | | |
| 100-150 TBN calcium sulfonate detergent[b] | | 0.15 | | |
| 165 TBN calcium detergent, predominantly alkyl salicylate | | | 0.26 | |
| 400 TBN calcium detergent, mixture of fatty carboxylate and alkyl phenate | | | | 0.7 |
| Test Results, Sequence VIB, ILSAC GF-3 | | | | |
| Initial Fuel Economy (passing = 1.6) | 2.0, 1.8, 2.0 | 1.4 | 1.6 | 1.8 |
| Durability (passing = 1.3) | 1.5, 1.1, 1.3 | n.d. | 1.1 | 1.1 |

n.d. = not determined
[a]A synthetic sulfonate detergent
[b]A natural sulfonate detergent The results show that use of a sulfonate detergent in the substantial absence of other detergents can lead to passing values for the Sequence VIB test as defined by the ILSAC GF-3 specification for fuel economy and durability. It is preferable that the sulfonate detergent component is predominantly (≧85 or 90% by weight) based on a synthetic detergent, and likewise that it is predominantly (≧85 or 90%) a detergent with a high Total Base Number (TBN≧150).

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); (2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy); (3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A composition suitable for lubricating an internal combustion engine, comprising:

(a) an oil of lubricating viscosity;

(b) an overbased detergent, wherein the detergent is exclusively or predominantly a linear alkylbenzenesulfonate detergent having a metal ratio of at least about 8, wherein in said composition the amount of phenate detergent is less than about 15% by weight of the total amount of detergents (c) a combination of antioxidants comprising (i) about 0.1 to about 2 weight percent hindered phenolic ester antioxidant and (ii) about 0.2 to about 2 weight percent aromatic amine antioxidant; and (d) at least one further component selected from the group consisting of dispersants, zinc dialkyldithiophosphates, and friction modifiers.

2. The composition of claim 1 wherein the detergent is exclusively or predominantly a calcium overbased synthetic linear alkylbenzenesulfonate detergent, the alkylbenzene group in said detergent having a number average molecular weight of about 320 to about 700.

3. The composition of claim 2 wherein the composition contains less than about 500 parts per million by weight of metals other than calcium or zinc.

4. The composition of claim 1 further comprising at least one salicylate detergent, saligenin detergent, or salixarate detergent.

5. The composition of claim 1 wherein the amount of any detergent other than the alkylbenzenesulfonate detergent is less than about 15% of the amount of the total amount of detergents.

6. The composition of claim 1 wherein the amount of any phenate detergent is less than about 1% by weight of the total amount of detergents.

7. The composition of claim 1 wherein the composition comprises a zinc dialkyldithiophosphate wherein said alkyl groups are predominantly secondary, in an amount to deliver about 0.025 to about 0.1 weight percent phosphorus to the composition.

8. The composition of claim 1 wherein the antioxidant component (c) further comprises about 0.1 to about 1 weight percent of a sulfurized olefin.

9. The composition of claim 8 wherein the sulfurized olefin is sulfurized 4-carbobutoxy cyclohexene.

10. A composition prepared by admixing the components of claim 1.

11. A method for lubricating an internal combustion engine, comprising supplying thereto the composition of claim 1.

12. A composition suitable for lubricating an internal combustion engine, comprising:

(a) an oil of lubricating viscosity;

(b) an overbased detergent, wherein the detergent is exclusively or predominantly a synthetic linear alkylbenzenesulfonate detergent having a metal ratio of at least about 8 and the alkylbenzene group therein having a number average molecular weight of about 320 to about 700, wherein in said composition the amount of phenate detergent is less than about 1% by weight of the total amount of detergents and the total amount of detergents other than the alkylbenzenesulfonate is less than about 15% by weight of the total amount of detergents;

(c) a combination of antioxidants comprising (i) about 0.1 to about 2 weight percent hindered phenolic ester antioxidant, (ii) about 0.2 to about 2 weight percent aromatic amine antioxidant, and (iii) about 0.1 to about 1 weight percent of a sulfurized olefin antioxidant; and (d) a zinc dialkyldithiophosphate wherein said alkyl groups are predominantly secondary, in an amount to deliver about 0.025 to about 0.1 weight percent phosphorus to the composition;

wherein the composition contains less than about 300 parts per million by weight of metals other than calcium or zinc.

13. A concentrate comprising (a) a concentrate-forming amount of an oil of lubricating viscosity;

(b) an overbased detergent, wherein the detergent is exclusively or predominantly a linear alkylbenzenesulfonate detergent having a metal ratio of about at least about 8 and the alkylbenzene group therein having a number average molecular weight of about 320 to about 700, wherein in said composition the amount of phenate detergent is less than about 15% by weight of the total amount of detergents;

(c) a combination of antioxidants comprising (i) hindered phenolic ester antioxidant and (ii) aromatic amine antioxidant; and (d) at least one further component selected from the group consisting of dispersants, zinc dialkyldithiophosphates, and friction modifiers.

* * * * *